US007556151B2

(12) United States Patent
Seijas

(10) Patent No.: US 7,556,151 B2
(45) **Date of Patent: *Jul. 7, 2009**

(54) DEVICE AND METHOD FOR INDICATING SCHEDULED DOSES

(76) Inventor: James Seijas, 102 Upper Mountain Ave., Upper Montclair, NJ (US) 07042

( * ) Notice: Subject to any disclaimer, the term of this patent is extended or adjusted under 35 U.S.C. 154(b) by 198 days.

This patent is subject to a terminal disclaimer.

(21) Appl. No.: 11/732,395

(22) Filed: Apr. 3, 2007

(65) Prior Publication Data

US 2007/0187282 A1 Aug. 16, 2007

Related U.S. Application Data

(63) Continuation of application No. 10/460,795, filed on Jun. 13, 2003, now Pat. No. 7,222,736.

(51) Int. Cl.

| | |
|---|---|
| ***B65D 83/04*** | (2006.01) |
| ***B65D 51/00*** | (2006.01) |
| ***B65D 85/00*** | (2006.01) |
| ***G09F 9/00*** | (2006.01) |

(52) U.S. Cl. ..... 206/534; 116/308; 116/309; 116/317; 116/318; 206/459.1; 215/230

(58) Field of Classification Search ..... 206/534, 206/459.1; 215/230; 116/308, 309, 317–319, 116/312

See application file for complete search history.

(56) References Cited

U.S. PATENT DOCUMENTS 2,066,183 A 12/1936 Mehaffey
2,690,801 A 10/1954 Perl
2,817,451 A 12/1957 Giles et al.
3,446,179 A 5/1969 Bender
3,960,713 A 6/1976 Carey
4,011,829 A 3/1977 Wachsmann et al.
4,345,541 A 8/1982 Villa-Real
4,347,804 A 9/1982 Villa-Real
4,432,300 A 2/1984 Lyss
4,489,834 A 12/1984 Thackrey
4,501,370 A 2/1985 Kelley
4,641,759 A 2/1987 Kelley
4,749,093 A 6/1988 Trick
4,782,966 A 11/1988 Thackrey
4,802,438 A 2/1989 DeJonge
4,920,912 A 5/1990 Kirkling
4,985,879 A 1/1991 Owens
5,011,032 A 4/1991 Rollman
5,082,129 A 1/1992 Kramer
5,261,548 A 11/1993 Barker et al.
5,299,701 A 4/1994 Barker et al.
5,358,117 A 10/1994 Adams (Continued)

*Primary Examiner*—Byron P Gehman
(74) *Attorney, Agent, or Firm*—Lerner, David, Littenberg, Krumholz & Mentlik, LLP

(57) ABSTRACT

A reminder device can be attached to the bottom of a medicine container that has a cap. The reminder device has an indicator rotatably mounted on a base in order to rotate and indicate a scheduled event. The base adhesively or frictionally engages the bottom of the container opposite the cap. The base may have an opening for engaging the bottom of the medicine container. Along some transverse plane within the opening, the opening may be shaped to engage the container along most of its periphery. A user can adjust the indicator on the base to indicate a scheduled event when medicine is ingested.

15 Claims, 1 Drawing Sheet

U.S. PATENT DOCUMENTS

| | | | |
|---|---|---|---|
| 5,482,163 | A | 1/1996 | Hoffman |
| 5,662,224 | A | 9/1997 | Nogues |
| 5,678,712 | A | 10/1997 | Rios |
| 5,720,392 | A | 2/1998 | Price |
| 5,823,346 | A | 10/1998 | Weiner |
| 6,003,467 | A | 12/1999 | Shelton-Ferrell et al. |
| 6,089,180 | A | 7/2000 | Nichols, Jr. |
| 6,779,480 | B2 | 8/2004 | Zamjahn |

DEVICE AND METHOD FOR INDICATING SCHEDULED DOSES

CROSS-REFERENCE TO RELATED APPLICATIONS

The present application is a continuation of U.S. patent application Ser. No. 10/460,795, filed Jun. 13, 2003, now U.S. Pat. No. 7,222,736, the entire disclosure of which is hereby incorporated herein by reference.

The present invention relates to indicating devices and methods, and in particular, to placing reminders on medicine containers.

People have difficulty remembering when to administer or self-administer a medicine. People often forget whether they have taken the day's daily dosage, especially if the dose is not taken at a regular time of day. Similar difficulties arise when doses must be taken several times a day on a predetermined schedule. These difficulties are greatly increased when several different medications must be taken on different schedules. Then one must remember not only the scheduled times, but which one of several medications must be taken at each time.

A very common approach to solving this scheduling problem is incorporating a mechanical scheduling device into a medicine container. One of the drawbacks of the known devices is their tendency to make the medicine container top-heavy and thus unstable. Another disadvantage is the tendency to inadvertently change the setting of the indicating device when handling or opening the medicine container.

Moreover, these known devices have been incorporated in or near a child-proof cap where relatively high forces must be applied by hand. Accordingly, these scheduling devices can be damaged by the high forces associated with opening a child-proof cap. These devices also tend to interfere with or obstruct the normal operation of the child-proof cap. This interference is especially problematical for persons with poor hand strength or coordination and therefore may have difficulty opening a medicine container, with or without a child-proof cap, if the scheduling device provides any kind of obstruction or interference.

In FIGS. 1-2 of U.S. Pat. No. 4,920,912 a disk with a window is connected by its axle to a cap. Rotating the disk exposes markings on the cap to indicate the time of the last or next dose. In the embodiment of FIGS. 3-4 a sleeve has a window that exposes time markings on the side of cap for the same purpose.

In U.S. Pat. No. 3,960,713 a cover can rotate about a stub to expose markings on an underlying cap. In FIGS. 4-6, a shell can rotate around a cap so that a window can expose markings on the cap.

In U.S. Pat. No. 5,082,129 an outer housing connects through a ratchet mechanism to a threaded cap. The housing can be rotated clockwise to tighten the cap. Overtightening will cause the ratchet mechanism to slip so that a window will move relative to the markings on the cap and thereby display updated reminders regarding the medication in the container.

In U.S. Pat. No. 5,662,224 a ring with time markings can be rotated about the neck of a medicine container to align with a pointer to indicate the last time a medicine was taken. See also U.S. Pat. No. 4,802,438.

In U.S. Pat. No. 6,089,180 a wire loop acting as a pointer is wrapped around the neck of a medicine container to point to time markings on a band encircling the container. Also a cap is marked with days of the week and is covered by a shell having an opening. Rotation of the shell can expose the week markings.

In U.S. Pat. No. 5,482,163 a collar with time markings fits around a medicine container marked with an arrow. The collar can be rotated to indicate when a dose was last taken.

In U.S. Pat. No. 4,347,804 a disk is rotatably mounted in a recess atop a cap for a medicine container. The disk has two pointers at a fixed spacing for indicating the time of the last and the next dose.

In U.S. Pat. No. 4,345,541 a ring is rotatably mounted on a central hub atop a cap for a medicine container. Again, the ring has two pointers at a fixed spacing for indicating the time of the last and the next dose.

In U.S. Pat. No. 4,501,370 an indicator disk rotatably mounted in a central hole in a cap for a medicine bottle can point to markings on the cap to indicate the time for the next dose.

In U.S. Pat. No. 5,358,117 a simple arrow rotatably mounted on a cap for a medicine container can be rotated to point to markings on the cap to indicate the time for the next dose.

In U.S. Pat. No. 4,641,759 the inner threaded cap has a hub molded with a pointer. An outer shell is mounted on the hub to form a child-proof cap. If no pressure is applied the outer shell can be rotated counterclockwise to align arrow with a marking on the shell indicating the time to take the next dose.

In U.S. Pat. No. 3,446,179 an upper pointing disk has a barrel that fits in a cavity in a threaded cap. The pointing disk can be rotated to point to markings on the underlying threaded cap to indicate either the time of the last or next dose. The pointing disk may either have an opening to expose one of the markings on the underlying cap or be transparent so that an arrow on the disk can be aligned with the visible markings on the underlying cap.

In U.S. Pat. No. 4,432,300 a cap has an opening that can align with one of the four openings shown in the housing of FIG. 7 to allow dispensing of a pill. In some designs a ratchet allows the cap to be rotated in only one direction, so that the user first sees one of the messages marked on the housing before clearing a dispensing opening. One embodiment has a dispensing opening facing from the top and another embodiment has a dispensing opening facing to the side.

In U.S. Pat. No. 5,011,032 a slide can be moved circumferentially to indicate the number of pills per dose.

In U.S. Pat. No. 6,003,467 a ring or disk has seven raised elements that can fit into seven openings in a cap for a medicine bottle container. When the cap is removed the underlying raised elements can be rotated to place one of the raised elements through a specific hole in the cap that is marked with an arrow to indicate the next day when a dose is due.

In U.S. Pat. No. 5,261,548 a cover has a window that exposes one of the markings on indicator wheel. The device has a ratchet mechanism that allows the indicator wheel to advance relative to window every time the device is removed from a medicine container. See also U.S. Pat. Nos. 5,299,701; 4,011,829; 4,749,093; 4,782,966; 4,489,834; 5,678,712.

Accordingly, there is a need for an improved technique for reminding people of when to take medication from one or more medicine containers.

SUMMARY OF THE INVENTION

In accordance with the illustrative embodiments demonstrating features and advantages of the present invention, there is provided a reminder device adapted for attachment to a medicine container. The reminder device has a base and an indicator rotatably mounted on the base in order to rotate and indicate a scheduled event. The base has an opening for frictionally engaging the bottom of the container. The base along some transverse plane within the opening is shaped to engage the container along most of its periphery.

In accordance with another aspect of the present invention a reminder device can hold medicine. The reminder device has a container for holding medicine, and a cap for closing the container. Also included is a base adapted to attach to the bottom of the container. The reminder device also has an indicator rotatably mounted on the base in order to rotate and indicate a scheduled event.

In accordance with yet another aspect of the present invention a reminder device is adapted for attachment to a medicine container. The reminder device has a base with an inner side for adhesively engaging the bottom of the container. Also included is an indicator rotatably mounted on the base in order to rotate and indicate a scheduled event.

In accordance with still yet another aspect of the present invention a method is provided for indicating a scheduled event. The method employs an adjustable indicator base and a medicine container having a cap. The method includes the step of attaching the adjustable indicator base to the bottom of the medicine container opposite the cap. Another step is adjusting the indicator base to indicate a scheduled event when medicine is ingested.

By employing devices and methods of the foregoing type an improved technique is achieved for reminding a person when medication was last administered (or when to next administer medication) in a container. In a preferred embodiment a short cylindrical base is forced fitted onto the bottom of a medicine container (alternatively, a flatter base can be adhesively secured to the bottom of the medicine container). The exposed face of this base has a recess containing a rotatably mounted indicator, for example, a disk molded with an arrowhead pointer. This pointer can be rotated to point at an indicia marked on the frustoconical sidewalls of the recess in order to indicate an hour of the day. Also in this preferred embodiment, the disk has an aperture that acts as a window to expose one of the indicia on the floor of the recess in order to indicate the desired date of the week.

The base is arranged to give the medicine container a wider and more stable base to prevent tipping. In contrast, indicating devices attached to the top of a medicine container tend to destabilize. Moreover, placing the base on the bottom of the medicine container avoids interference with removing the cap on the container. Also, the base can provide a gripping surface to make removing the cap easier.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION

Figure 1:
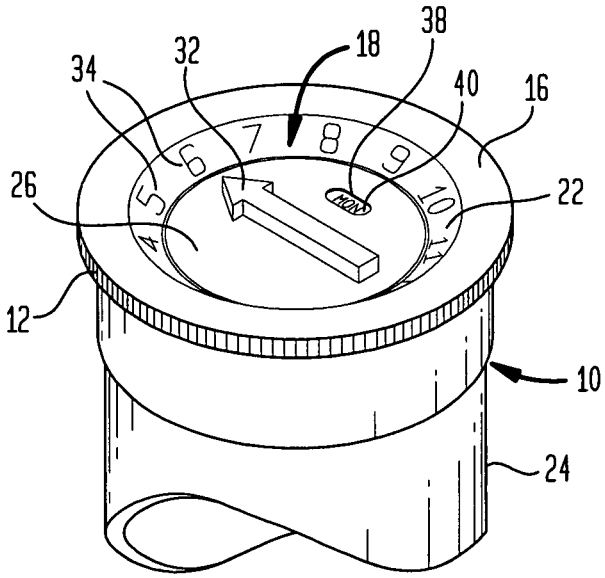
FIG. 1 is as a perspective view of a reminder device installed on the bottom of an inverted medicine container, the upper portion of which is broken away for illustrative purposes.
Figure 2:
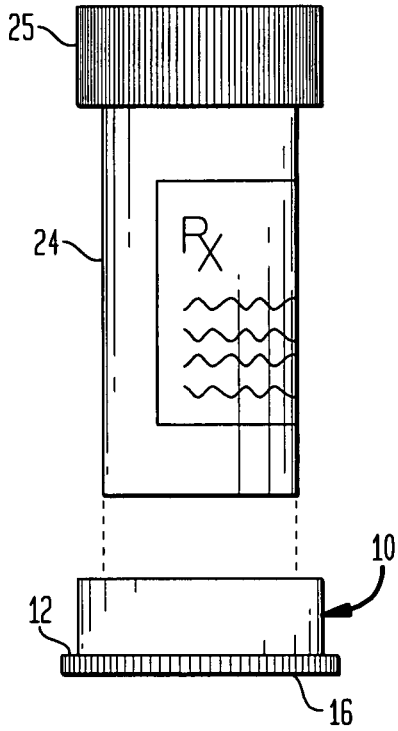
FIG. 2 is an elevational view of the reminder device of FIG. 1 about to be installed on the bottom of the medicine container.
Figure 3:
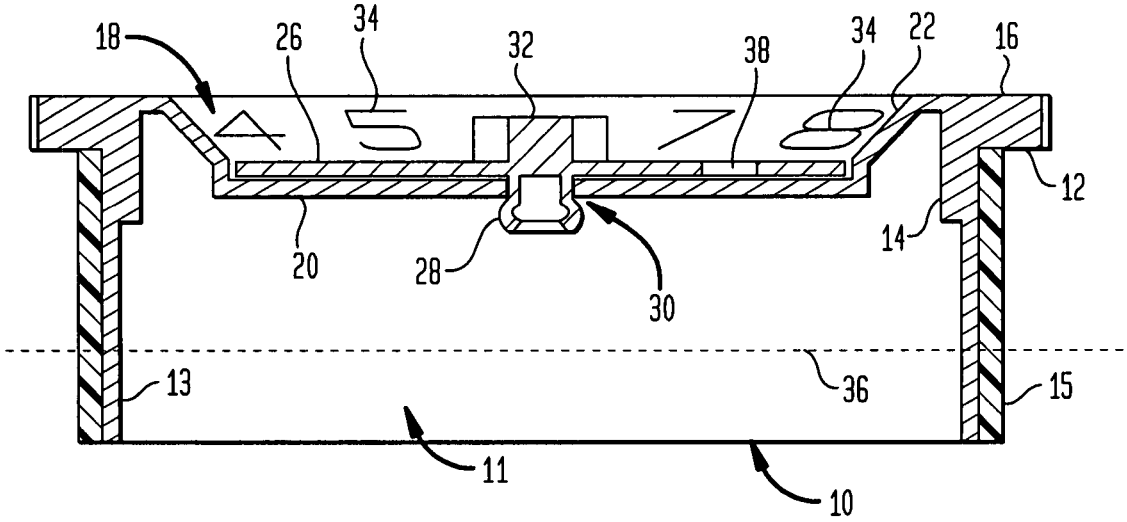
FIG. 3 is an elevational, sectional view of the reminder device of FIG. 1.

Referring to FIGS. 1-3, a reminder device is shown as an adjustable indicator base 10. The base 10 has a mostly cylindrical shape but includes a flange 12 on the outside and a shoulder 14 on the inside. Flange 12 is knurled to provide a grip-enhancing periphery. Also, the outside of base 10 can be coated with an elastomeric material 15 that can also acts as a grip enhancing periphery.

Outside face 16 of base 10 has a recess 18 with a floor 20 surrounded by a frustoconical sidewall 22. On the opposite side of face 16 is an opening 11 in base 10, which opening is shown forced fitted onto the bottom of a medicine container 24. The bottom of container 24 can be thrust into opening 11 and up against shoulder 14, which acts as a stop. Once installed, the outside face 16 of base 10 acts as a support platform to hold medicine container 24 erect.

The inside surface 13 of opening 11 may be relatively smooth and cylindrical to provide intimate contact and high friction between base 10 and container 24.

Friction can be increased in some embodiments by roughening surface 13 or by coating it with a friction-enhancing substance such as an elastomeric material. Preferably, the contact between inside surface 13 and the outside surface at the bottom of container 24 is so intimate that most of the periphery of container 24 is engaged by inside surface 13 along some transverse plane, for example transverse plane 36 (although plane 36 is exemplary and the conditions existing at plane 36 will likewise exist at many other transverse planes neighboring plane 36). This intimate contact can be maintained whether surface 13 is smooth or roughened.

An indicator 26 is rotatably mounted at the floor 20 of recess 18. Molded on the underside of disk 26 is a cup-shaped axle 28 with a bulbous rim having an inturned lip. Axle 28 is designed to snap into hole 30 in the floor 20 of recess 18. A radial pointer 32 in the form of an arrowhead is molded on the outside of disk 26. Disk 26 can be rotated so that pointer 32 can point to any of an encircling plurality of indicia 34 (e.g., the 12 numeric indicia shown in FIG. 1) marked on the wall 22 in order to indicate the hour of the day for a scheduled event. Of course pointer 32 can point between the discrete indicia 34 to indicate a time in between.

Disk 26 has an oval opening 38 acting as a window to expose one of an encircled plurality of indicia 40 marked on the outside of floor 20 in order to indicate a day of the week for a scheduled event. Thus, a user can rotate disk 26 to indicate either an hour of the day, or a day of the week, but not both simultaneously. In alternate embodiments only one of the two techniques for indicating day or hour may be employed. In other embodiments, both day and hour can be indicated but with the positions of the indicia reversed. It will be appreciated that in still other embodiments disk 26 may be rotated to align indicia on the disk with a pointer marked on sidewall 22.

Figure 4:
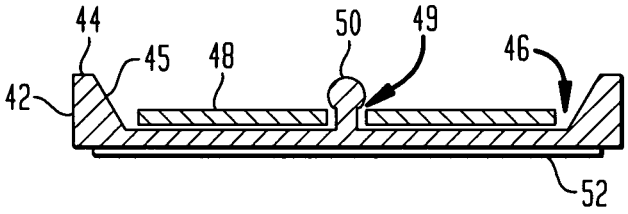
FIG. 4 is an elevational, sectional view of a reminder device that is an alternate to that of FIG. 1.

Referring to FIG. 4, an alternate reminder device is shown as a disk-like base 42 having a ridge 44 with a frustoconical wall 45 encircling a recess 46. A hole 49 in indicator disk 48 snaps over the bulbous end of an upright axle 50 molded on base 42. Disk 48 may have a printed, engraved, or embossed pointer that can point at various indicia that are printed, embossed, or engraved on the wall 45 in order to indicate an hour of the day or a day of the week. As before, a window may be formed in indicator 48 to expose indicia marked on base 42 underneath the disk.

In this embodiment, base 42 does not have a cylindrical opening that force fits onto a medicine container. Instead, an adhesive layer 52 is placed on the inner side of base 42. In some embodiments that adhesive layer 52 may be supplied with a protective paper (not shown) that is removed just before adhering base 42 to the bottom of a medicine container.

To facilitate an understanding of the principles associated with the foregoing apparatus, its operation will be briefly described. The operation of the reminder device will be explained in connection with the embodiment of FIGS. 1-3, but it will be appreciated that the operation for the embodiment of FIG. 4 will be similar. The user will select a base 10 having an inside diameter-matching the outside diameter of medicine container 24. The containers 24 are typically mass-produced in a limited number of standard sizes. Therefore, standard base sizes would be supplied for these popular containers. In some cases, however, the inside surface 13 will be fitted with a number of gripping barbs or ridges that will deflect to accommodate containers of various sizes. In other embodiments base 10 may be stretchable. If necessary, the reminder device can be glued in place with an epoxy or other relatively thick compound that will fill in any space that might otherwise exist between the container 24 and the base 10.

Preferably, the reminder device will be easily removed from an empty medicine container and reinstalled on another container. This feature accommodates the common situation where a prescription is refilled and provided in a new container.

Once installed, indicator disk 26 can be rotated to point to a scheduled event when a medication will be ingested next (or when a medication was ingested last). If the medication must be taken several times throughout the day a user will most conveniently set pointer 32 to indicate the hour when the medication must next be ingested. If the medication is taken once per day, window 38 may be positioned to indicate the day when the medication must be ingested next. Installing the reminder device on a specific medicine container will facilitate handling medications with different schedules. The medication for each container can be separately and independently scheduled by using a reminder device dedicated to that one medication.

Distinct advantages flow from mounting the reminder device on the bottom of a medicine container. In particular, the reminder device is located away from the cap 25. This prevents interference with the removal of cap 25, which can be important when the user's hand strength is impaired or cap 25 is a childproof or tamper-resistant cap that is ordinarily difficult to remove. Moreover, base 10 can have grip-enhancing qualities by virtue of the knurled edge of flange 12 or the elastomeric texture of coating 15. Thus the user can securely grip the container 24 by holding base 10. Since the base 10 has a greater outside diameter than the bottom of container 24, increased leverage may be applied to cap 25.

Also, the setting of indicator 26 is less likely to be disturbed because the indicator is mounted in recess 18. Thus, after one sets indicator 26 cap 25 may be replaced and the container 24 handled without a significant risk of disturbing the setting of the indicator 26.

Also, placing the reminder device on the bottom of container 24 makes that container more stable. If one were to place a reminder device in or on cap 25, container 24 would become top-heavy and would tend to tip. With many such top-heavy containers in a medicine cabinet, toppling one container would cause a chain reaction with many containers tumbling out of a medicine cabinet. In contrast, the present reminder device increases the stability of medicine container 24 by making the container bottom-heavy, that is, by lowering the center of gravity of the container.

It is appreciated that various modifications may be implemented with respect to the above described, preferred embodiments. While the above reminder device is preferably molded in plastic, in other embodiments the device can be made of stamped metal, ceramics, etc. Also, the overall dimensions of the device can be altered depending upon the targeted medicine container, the desired strength, etc. Moreover, in some embodiments multiple independent indicators can be employed to allow one to separately and independently indicate an hour of the day and a day of the week. Furthermore, the indicator can be one or more rings that rotate in or on annular tracks. Also, the indicating device need not employ a raised arrowhead and may take various alternate shapes. In addition, the indicator disk need not rotate by means of an axle but may instead be fitted inside a circular track to rotate inside that track. Also, any reference to an indicator disk being located in a recess should be taken as a relative characterization, so that a generally flat surface having an annular ridge may be deemed to provide a recess that is located within that ridge. Furthermore, the stability offered by the above base can be enhanced not only with a flange but with a number of radially projecting spokes.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements maybe be devised without departing from the spirit and scope of the present invention as defined by the appended claims.

The invention claimed is:

1. A reminder device adapted for attachment to a medicine container, the reminder device comprising:

a base having an opening for frictionally engaging the bottom of a container, the base along some transverse plane within the opening being shaped to engage the container along most of its periphery, the base having an outer recess and a grip-enhancing periphery, the base having a flat surface for stably supporting the base and the container; and an indicator rotatably mounted in the recess so as not to extend beyond the flat surface in order to rotate and indicate a scheduled event, the base being arranged to engage the container to allow the indicator to rotate relative to the base without causing the base to rotate relative to the container, the reminder device having an encircling plurality of indicia and an encircled plurality of indicia, the indicator being arranged to indicate at least one from (a) the encircling plurality of indicia, and (b) the encircled plurality of indicia.

2. A reminder device according to claim 1, wherein the grip-enhancing periphery includes a knurled flange.

3. A reminder device according to claim 1, wherein the base has a grip-enhancing elastomeric coating.

4. A reminder device according to claim 1, wherein one of the encircling plurality and the encircled plurality of indicia signify a time of day and the other one of the encircling plurality and the encircled plurality of indicia signify a day of the week.

5. A reminder device according to claim 1, wherein the indicator comprises a disc.

6. A reminder device according to claim 5, wherein the disc has an axle, and the base has a hole therein for rotatably holding the axle.

7. A reminder device according to claim 5, wherein the base has an axle, and the disc has a hole therein for rotatably engaging the axle.

8. A reminder device according to claim 5, wherein the disc has a window for viewing the encircled plurality of indicia.

9. A reminder device according to claim 8, wherein the disc has a radial pointer for pointing to one of the encircling plurality of indicia, the encircled plurality of indicia being selectively exposed by the window on the disc.

10. A reminder device according to claim 1, wherein the base has opposite the opening an outside face providing a support platform for stably holding the container erect.

11. A reminder device according to claim 10, wherein the platform has an outside diameter exceeding the inside diameter of the opening, so that the container with the reminder device installed has a larger footprint and is less likely to tip.

12. A reminder device according to claim 10, wherein the recess containing the indicator is sized to prevent the indicator from projecting beyond the platform.

13. A reminder device according to claim 12, wherein the recess has a floor surrounded by a wall marked with the encircling plurality of indicia.

14. A reminder device according to claim 1, wherein the opening has an inside surface adapted for force fitting onto the container.

15. A reminder device according to claim 14, wherein the inside surface of the opening has a profile allowing most of the inside surface to touch the container.

* * * * *